US011253082B2

(12) United States Patent
Burt

(10) Patent No.: US 11,253,082 B2
(45) Date of Patent: Feb. 22, 2022

(54) OUTDOOR CHAIR WITH CUSHION COVERS

(71) Applicant: Marc Burt, Columbus, OH (US)

(72) Inventor: Marc Burt, Columbus, OH (US)

( * ) Notice: Subject to any disclaimer, the term of this patent is extended or adjusted under 35 U.S.C. 154(b) by 0 days.

(21) Appl. No.: 16/758,338

(22) PCT Filed: Oct. 31, 2018

(86) PCT No.: PCT/US2018/058336
§ 371 (c)(1),
(2) Date: Apr. 22, 2020

(87) PCT Pub. No.: WO2019/089679
PCT Pub. Date: May 9, 2019

(65) Prior Publication Data

US 2020/0337473 A1 Oct. 29, 2020

Related U.S. Application Data

(60) Provisional application No. 62/667,875, filed on May 7, 2018, provisional application No. 62/580,149, filed on Nov. 1, 2017.

(51) Int. Cl.
*A47C 31/11* (2006.01)
*A47C 1/14* (2006.01)
*B65H 75/44* (2006.01)

(52) U.S. Cl.
CPC ..... *A47C 31/113* (2013.01); *A47C 1/14* (2013.01); *B65H 75/44* (2013.01)

(58) Field of Classification Search
None
See application file for complete search history.

(56) References Cited

U.S. PATENT DOCUMENTS 4,118,066 A * 10/1978 Rieke ..... B60J 11/025 296/136.03
4,171,145 A * 10/1979 Pearson, Sr. ..... B62J 19/00 150/167

(Continued)

FOREIGN PATENT DOCUMENTS

CH 682903 A5 * 12/1993 ..... B62J 1/20
DE 3506872 A1 * 10/1985 ..... B60N 2/60

(Continued)

*Primary Examiner* — David E Allred
(74) *Attorney, Agent, or Firm* — Standley Law Group LLP; Stephen Grant

(57) ABSTRACT

A chair (10) has a chair frame (20) with a seat base (22), a seat cushion (30) sized and adapted for removable placement in the seat base and a chair back (26), attached to the seat base. A cover assembly for use therewith has a web (32) of water-resistant material, with first and second ends (34, 36) and a biased, window-shade type spring roller (50), positioned in the seat base. The first end of the web of water resistant material is attached to the spring roller and the second end of the web of water resistant material is provided with means for removably attaching the second end to the chair frame. In a first, deployed condition, the web of water-resistant material extends across a top surface of the seat cushion; and in a second, non-deployed condition, the web of water-resistant material is rolled onto the biased, window-shade type spring roller.

8 Claims, 6 Drawing Sheets

(56) References Cited

U.S. PATENT DOCUMENTS 4,320,922 A * 3/1982 Meritis ..... B60N 2/6027 160/301
4,600,238 A 7/1986 Goodford
4,851,504 A * 7/1989 Suzuki ..... C08G 63/6926 528/287
4,930,838 A * 6/1990 Brabant ..... A47C 7/021 297/184.14
5,080,431 A * 1/1992 Frazier ..... B62J 1/20 297/184.11
5,829,828 A * 11/1998 Asfaw ..... A47C 31/11 297/219.1
6,158,805 A 12/2000 Blaney
6,309,017 B1 10/2001 Middleton
6,659,551 B1 * 12/2003 Arenas ..... B60N 2/6027 160/23.1
6,709,055 B2 3/2004 Gengler et al.
7,690,725 B1 * 4/2010 Rawlings ..... A47C 31/11 297/229
2002/0157696 A1 * 10/2002 O'Brien ..... B60J 11/00 135/87
2008/0284217 A1 * 11/2008 Noonan ..... A47C 31/113 297/184.11
2009/0256378 A1 * 10/2009 Hibi ..... B60N 2/6009 296/65.01
2017/0290442 A1 * 10/2017 Rause ..... A47C 31/113

FOREIGN PATENT DOCUMENTS

DE 102007049893 A1 * 4/2009 ..... B62J 9/26
DE 202009013605 U1 4/2010
FR 2931740 A1 12/2009
GB 16641 6/1899
GB 191010754 A * 3/1911 ..... B62J 1/20
GB 168803 A * 9/1921 ..... B62J 1/20
GB 206225 A * 11/1923 ..... B62J 1/20
GB 214016 A * 4/1924 ..... B62J 1/20
GB 624473 A * 6/1949 ..... B62J 1/20
JP 10024878 A * 1/1998 ..... B62J 19/00
WO WO-2011125340 A1 * 10/2011 ..... B62J 19/00

* cited by examiner

OUTDOOR CHAIR WITH CUSHION COVERS

TECHNICAL FIELD

This disclosure relates to a chair, preferably for outdoor use, having a chair frame with a seat cushion and a back cushion. The chair frame has at least one biased, window-shade type spring roller provided at a location in the chair frame, so that a web of water-proof covering may be selectively payed out therefrom, deployed over at least one of the cushions, and secured in place. Upon being unsecured, the web can be stowed by rewinding upon the at least one roller.

BACKGROUND OF THE ART

Outdoor furniture is a very popular item. Some of this furniture, when constructed from wood, metal or a polymeric material, can be left out in the weather without significant adverse effects. However, when cushions are used on seating surfaces of the furniture, it is customary to either remove the cushions or cover them with a separate cover during periods of inclement weather or extended non-use.

Furniture covers present at least a few problems. In strong winds, they can be blown away. When removed, they need to be stowed away. This latter problem can be particularly troublesome when the furniture is used on a terrace of a high-rise building, for example, where the owner may be short on storage space Some examples of furniture covers in the prior art include U.S. Pat. Nos. 6,309,017 and 6,709,055. However, neither of these patents teach a furniture cover that is stored inside the piece of outdoor furniture, from which it can deployed into a protective condition on the furniture.

SUMMARY

This and other unmet goals of the prior art are met by the embodiments of the cover assembly for a chair, as well as by a chair embodying the cover assembly.

The chair with which the cover assembly is employed has a chair frame with a seat base, a seat cushion, sized and adapted for removable placement in the seat base and a chair back, attached to the seat base.

The cover assembly, in a first embodiment, comprises a web of water-resistant material, having first and second ends; and a biased, window-shade type spring roller, positioned in the seat base, wherein the first end of the web of water resistant material is attached to the spring roller and the second end of the web of water resistant material is provided with means for removably attaching the second end to the chair frame.

In some embodiments of the cover assembly, the water-resistant material is a polymeric material, and, especially, the polymeric material impregnates the web, which comprises a woven fabric.

In many of the embodiments of the cover assembly, the web of water-resistant material, in a first, deployed condition, extends across a top surface of the seat cushion, and, in a second, non-deployed condition, the web of water-resistant material is rolled onto the biased, window-shade type spring roller.

In many of the embodiments of the cover assembly, the biased, window-shade type spring roller is mounted to the seat base, below the seat cushion.

In some embodiments of the cover assembly, the cover assembly further comprises a second cover assembly with a second web of water-resistant material, having first and second ends, and a second biased, window-shade type spring roller (60), positioned in the seat base, wherein the first end of the second web of water resistant material is attached to the second spring roller and the second end of the second web of water resistant material is provided with means for removably attaching the second end to the chair frame.

As in the first cover assembly, many of the second cover assemblies will use a polymeric material as the water-resistant web material, especially where the polymeric material impregnates the second web, which comprises a woven fabric.

Also, it is preferred that the second web of water-resistant material will extend, in a first, deployed condition, across a top surface of chair back, and, in a second, non-deployed condition, the web of water-resistant material is rolled onto the biased, window-shade type spring roller.

It is preferred that the second biased, window-shade type spring roller, when present, is mounted to the seat base, below the seat cushion.

Other objects of the inventive concept are provided by a chair, comprising: a chair frame, with a seat base, legs that are attached to the seat base and a chair back, also attached to the seat base; a seat cushion, removably placed in the seat base; and a seat cushion cover assembly that comprises a web of water-resistant material, having first and second ends; and a biased, window-shade type spring roller, positioned in the seat base, wherein the first end of the web of water resistant material is attached to the spring roller and the second end of the web of water resistant material is provided with means for removably attaching the second end to the chair frame.

In some embodiments, the chair also comprises a back cushion, removably attached to the chair back; and a second seat cushion cover assembly that comprises a second web of water-resistant material, having first and second ends; and a second biased, window-shade type spring roller (60), positioned in the seat base, wherein the first end of the second web of water resistant material is attached to the spring roller and the second end of the second web of water resistant material is provided with means for removably attaching the second end to the chair frame.

In some embodiments of the cover assembly, there is provided, for at least one of the cover assemblies, a brush means for brushing the web of water resistant material as the web is moved between the first, deployed condition and the second, non-deployed condition, the brush means being positioned to bear, adjustably and tangentially, against the outer circumference of the roller.

BRIEF DESCRIPTION OF THE DRAWINGS

The invention will be better understood when reference is made to the drawings filed herewith, wherein identical parts are identified with identical reference numbers and wherein.

DETAILED DESCRIPTION OF THE DISCLOSED EMBODIMENTS

Figure 1:
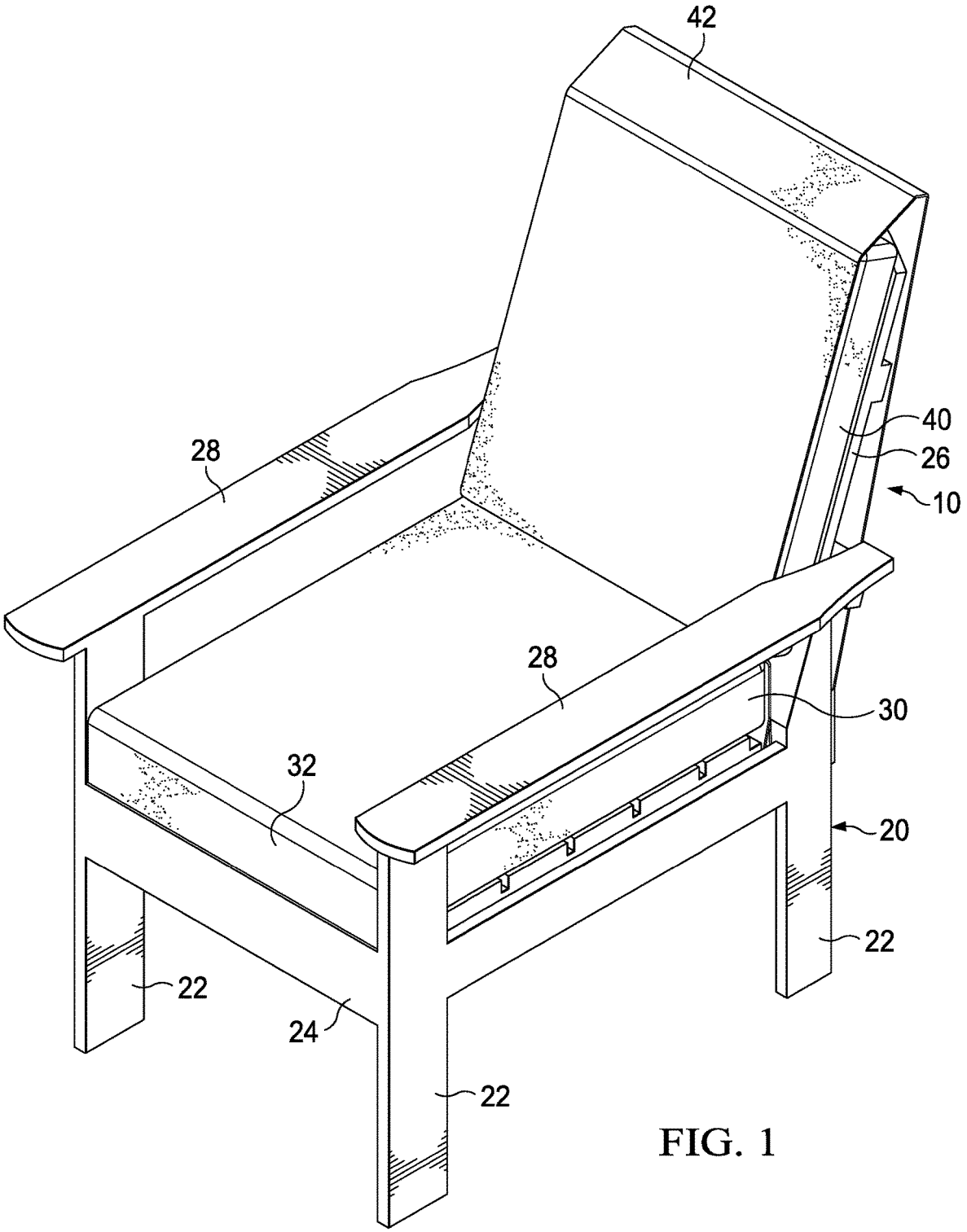
FIG. 1 is an assembled perspective view of an outdoor chair embodying the inventive concept, with the cushion covers deployed and secured.

FIG. 1 is a perspective view of an embodiment 10 of an outdoor chair that incorporates the inventive concept taught herein. The outdoor chair 10 as depicted has a frame 20 that is shown with legs 22, seat base 24, back 26 and arm rests 28. In general, these elements are effectively conventional and are not effectively changed by the implementation of the inventive concept. The frame 20 is depicted as if manufactured from wood, but a metallic frame or a frame constructed of a polymer-based wood substitute would also accommodate the inventive concept, as would other known materials.

As would be common with an outdoor chair 10, a seat cushion 30 and a back cushion 40 are also provided and depicted in FIG. 1. These cushions are depicted as being generally conventional. The cushions 30, 40 are shown as rectangular solid bodies, typically having a rectangular solid foam core and covered by a cloth or polymeric cover. The foam core is typically a polyurethane foam, so the cover is primarily intended to protect the core from UV radiation from sunlight and, to a lesser degree, moisture and wear from use.

In order to protect the cushions 30, 40 from the weather are, in this embodiment, a first cushion cover 32 and a second cushion cover 42. These cushion covers 32, 42 are depicted in a deployed condition in FIG. 1. The cushion covers 32, 42 are configured as rectangular webs of flexible material. They are preferably a polymeric material to provide water resistance and may be a polymeric material that is impregnated onto a woven fabric, to provide additional strength to the webs.

Figure 2:
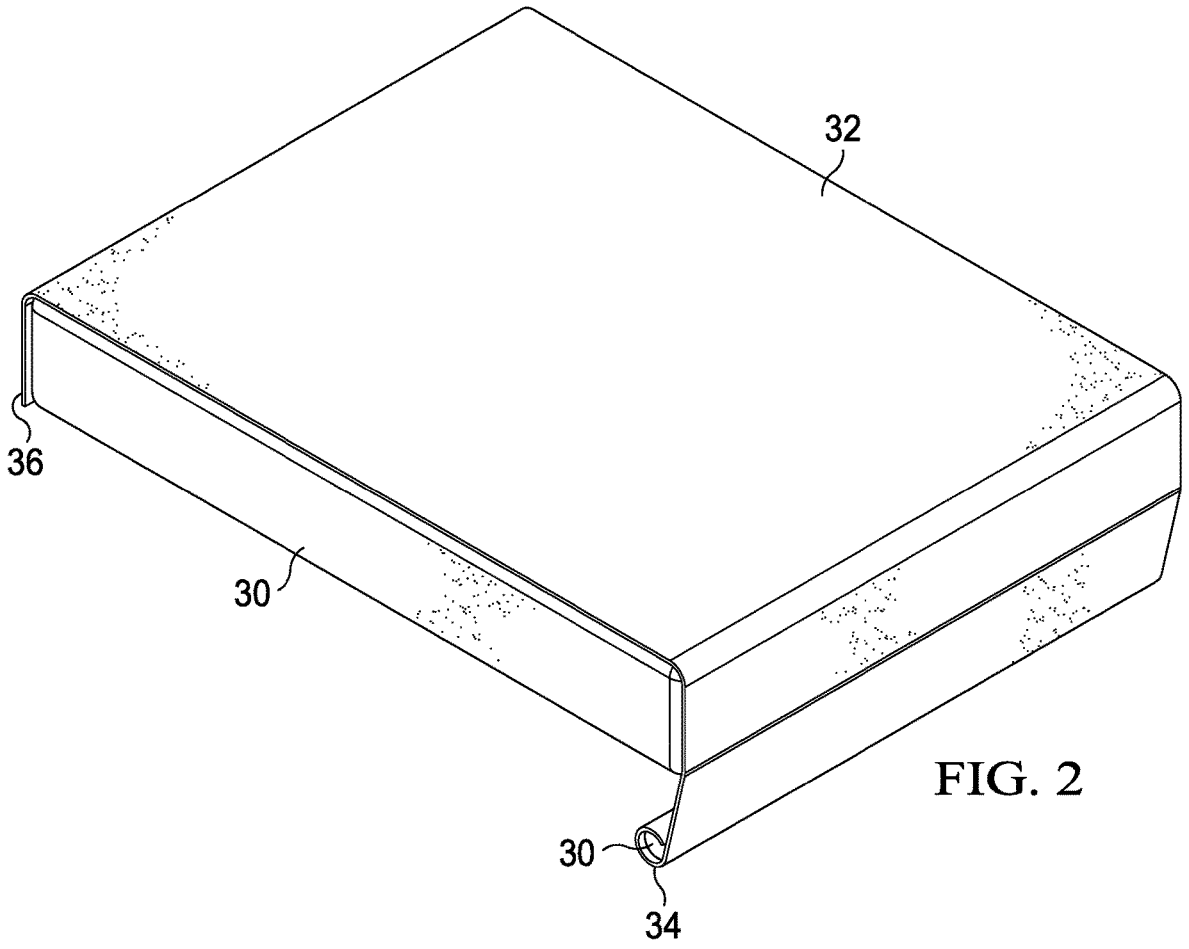
FIG. 2 is a perspective view of the seat cushion of the FIG. 1 chair, isolated from the chair frame to disclose details of the cushion and cover.
Figure 3:
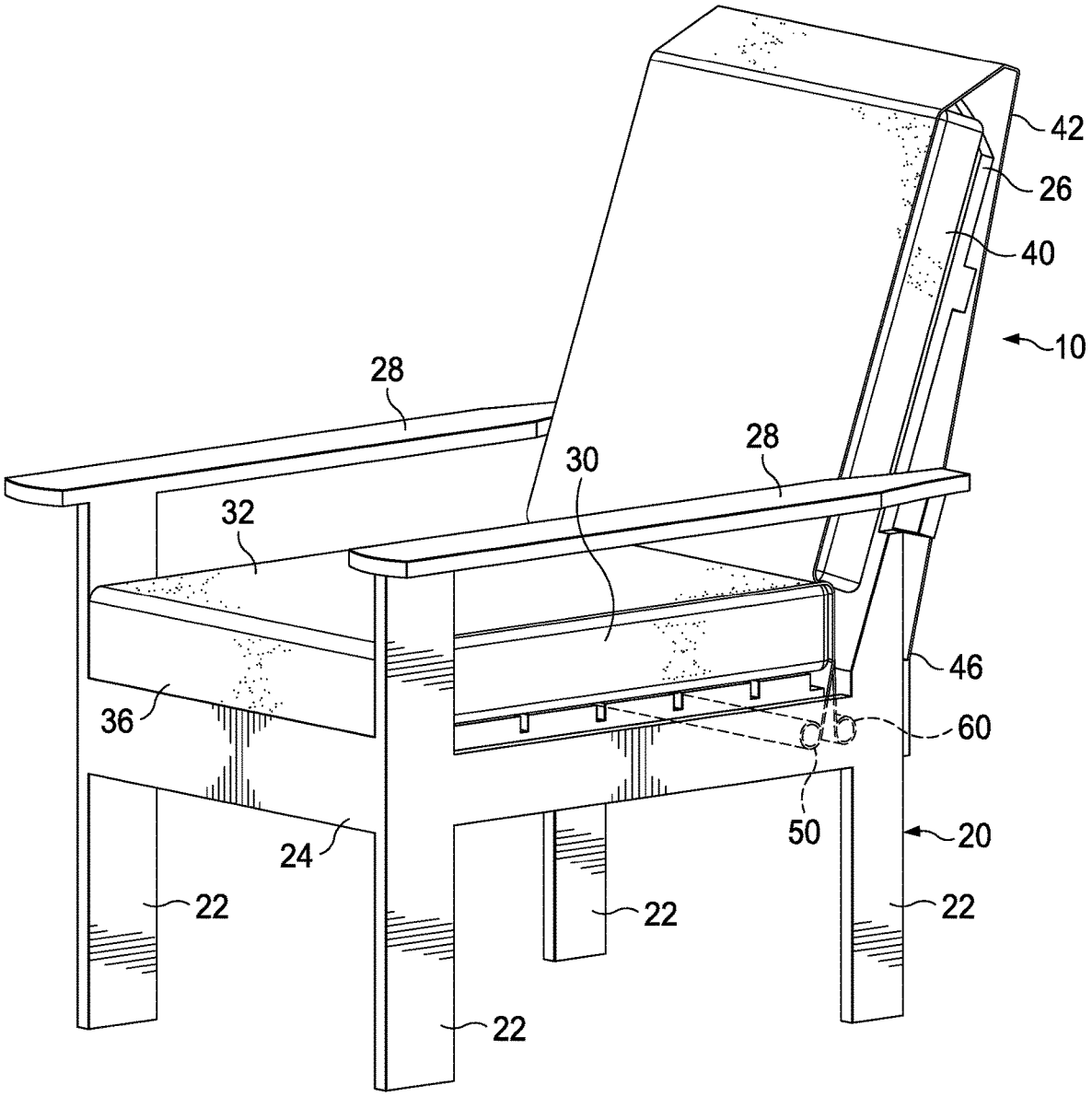
FIG. 3 is a further perspective view of the seat cushion of FIG. 2, shown in place with the outdoor chair shown in phantom lining.
Figure 4:
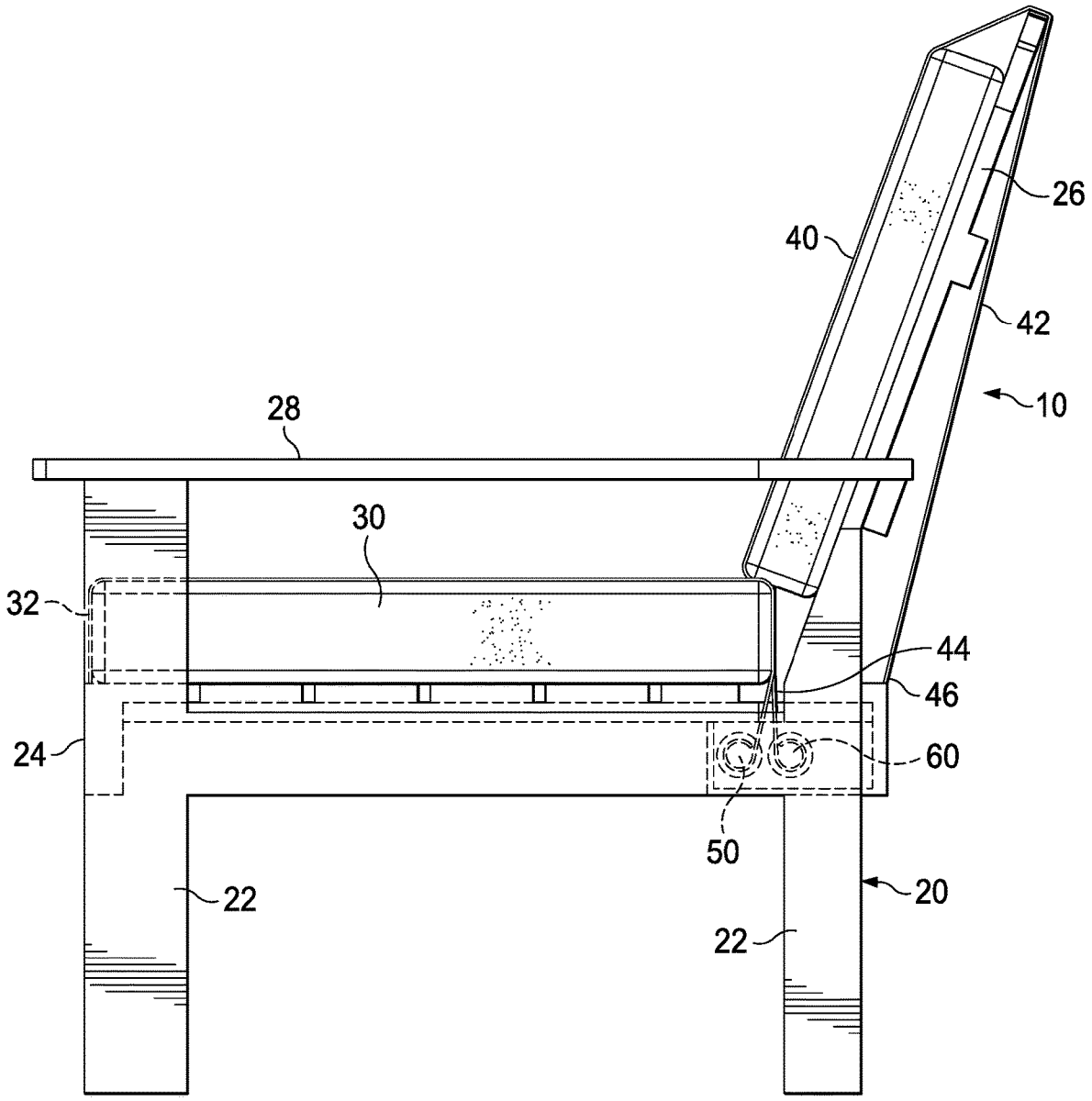
FIG. 4 is a side elevation view of the outdoor chair of FIG. 1, showing details of the cushions and cushion covers with the outdoor chair shown in phantom lining.

While not clearly shown in FIG. 1, but as seen better in FIGS. 2-4, each cushion cover 32, 42 has a first end 34, 44 that is attached to a roller that is built into the frame 20 of the chair 10 and a second end 36, 46 that can be used to unfurl or deploy the respective cushion cover from the roller.

In one embodiment, roller 50 is associated with cushion cover 32 and roller 60 is associated with cushion cover 42. The preferred roller 50, 60 is a biased, window-shade type spring roller of the kind known in the prior art. Such a roller 50, 60 will be arranged so that the bias provided by the spring of the roller normally holds the cushion cover associated with it in a rolled-up or non-deployed condition. The second ends 36, 46 are each preferably provided with a means for securing the second end to a portion of the frame 20 when the cushion covers 32, 42 are deployed. In many embodiments, each second end will also preferably have a rigid linear element passing across the cushion cover 32, 42, to provide rigidity to the transverse aspect of the cushion cover as it is deployed. Such a rigid linear element may also provide a useful gripping surface for extracting the cushion cover for deployment from inside the frame 20.

With regard to the need to provide a means for securing the deployed cushion covers 32, 42 to the frame 20, it is noted that there are at least two different types of biased, window-shade type spring roller that can be useful in the embodiments of the invention. In a first of these types, the rotation of the roller in deploying the web increases the amount of bias on the spring associated with the roller, so releasing the deploying force will allow the web to be rolled back onto the roller, unless the end of the web is secured. This is the older type of roller. In a newer type of biased, window-shade type spring roller, the web deploys while under a force, but the web does not retract upon release of the deploying force. Instead, a rather quick or sudden pull on the web in the deploying direction actuates the biasing force of the roller spring, causing the web to be retracted onto the roller, under what is usually a smooth, slow manner. While a securing means may be used in either case, the securing means is required when the first type of roller is used, but it is probably optional when the second type of roller is used. When used, the securing means can be a mechanical type of latch or hook, a pair of magnetic elements, and other known securing means. Selection of the type of roller and the securing means will be well within the skills of one having skill in this art.

Directing attention now to FIG. 2, the seat cushion 30 and the seat cushion cover assembly are shown in isolation from the chair 10. In this Figure, the cushion cover 32 is deployed. The roller 50 is shown as being located at a point below, and at the rear of, the seat cushion 30. The cushion cover 32, when deployed, comes vertically up the rear surface of the seat cushion 30, horizontally forward to the front of the seat cushion, and then vertically downwardly, to a point at which it can be secured to the frame.

The elements of FIG. 2 are now placed into context in association with a skeletonized depiction of the chair 10 in FIGS. 3 and 4. Here, the second cushion cover 42 is shown with the back cushion 40, which is deployed from roller 60, which is located close to, but behind, roller 50. In this way, it is seen that rollers 50, 60 are positioned in the frame 20 at the rear portion of seat base 24, near the junction with back 26. In the depicted version, cushion cover 42 extends not only upwardly across the back cushion 40, but also downwardly along a rear surface of the back 26, so that it is secured at a point that is not very far away from roller 60. In some embodiments, it may be preferred to secure the cushion cover 42 at a point much higher along the back 26.

In yet another embodiment that is not depicted here, a single roller may be used to deploy a single cushion cover over both cushions 30, 40. In such an embodiment, the cushion cover would be secured around a roller placed in a similar position to roller 60. However, instead of initially running up across the back cushion 40, the cover would extend horizontally back to the rear of the chair back 26, vertically up the back surface of back 26, take a short frontward horizontal path and then vertically down atop back cushion 40. At the bottom of the back cushion, a simple rod or roller, typically not spring-biased, would allow the cushion cover to move horizontally across seat cushion 30 and to be secured to a front surface of the seat base 24. In such a circumstance, the single cushion cover would be significantly longer than either cushion cover 32, 42 of the depicted embodiments.

Figure 5:
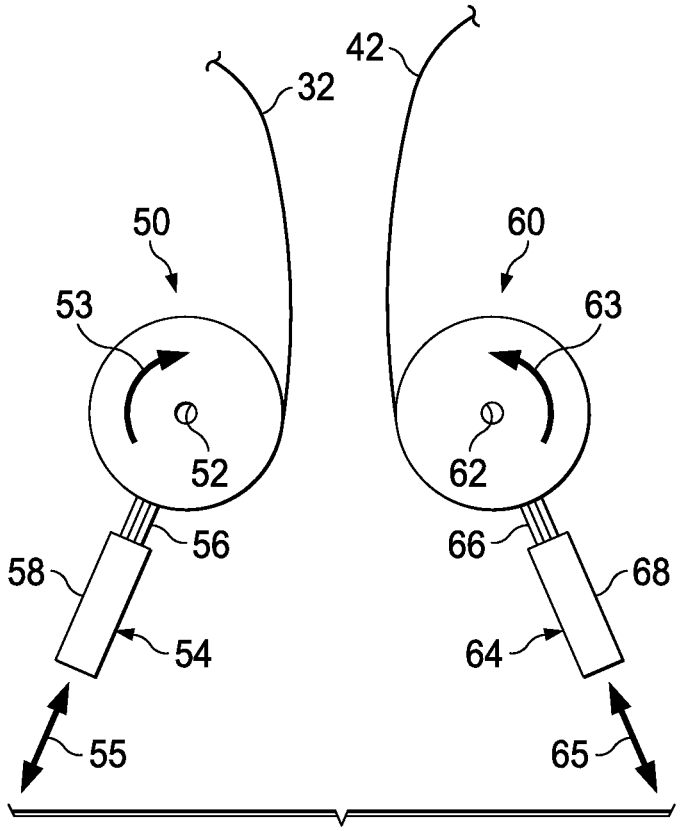
FIG. 5 is an enlarged end view of the roller portion of the inventive concept.
Figure 6:
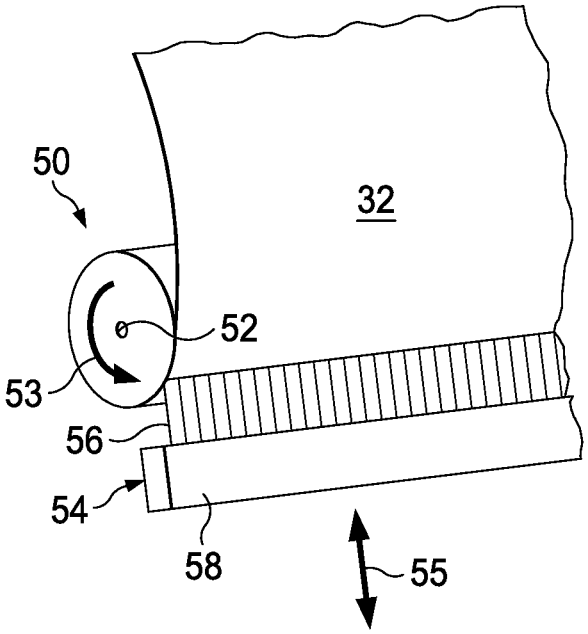
FIG. 6 is an enlarged perspective view of one of the rollers of FIG. 5.

Another feature that is generally considered optional to the primary invention is a brush means that is provided to remove dust, leaves and other debris from the cushion covers, particularly when the covers are rolled up onto the spring rollers. In the embodiment depicted in FIG. 4, it will be noted that roller 50 is arranged so that it rotates clockwise when gathering up the web of cushion cover 32 and that roller 60 rotates counterclockwise when gathering up the web of cushion cover 42. With that being the case, FIG. 5 depicts rollers 50, 60 in end view, with roller 50 arranged for clockwise rotation (as shown by arrow 53) to roll up cover 32 and with roller 60 arranged for counterclockwise rotation (as shown by arrow 63) to roll up cover 42. These rotations occur about the respective trunnions 52, 62. Brush means 54 is positioned to bear, adjustably and tangentially, against the outer circumference of roller 50 and brush means 64 is positioned to bear, adjustably and tangentially, against the outer circumference of roller 60. The direction of adjustability of the respective brush means 54, 64 is shown by arrows 55, 65. In the depicted embodiment, brush means 54 is an elongate bar 58 that is long enough to span across the entire width of cover 32, with bristles 56 placed along the edge that bears against the roller 50. Similarly, brush means 64 is an elongate bar 68 that is long enough to span across the entire width of cover 42, with bristles 66 placed along the edge that bears against the roller 60. In what is believed to be a preferred operational mode, the brush means 54, 64 do not engage the rollers 50, 60 when paying out the covers 32, 42, as the covers do not collect dust, etc., while rolled up. FIG. 5, however, shows the brush means 54, 64 engaged, as when gathering up the covers 32, 42. FIG. 6 shows a perspective view of the interaction of roller 50 with brush means 54.

Figure 7:
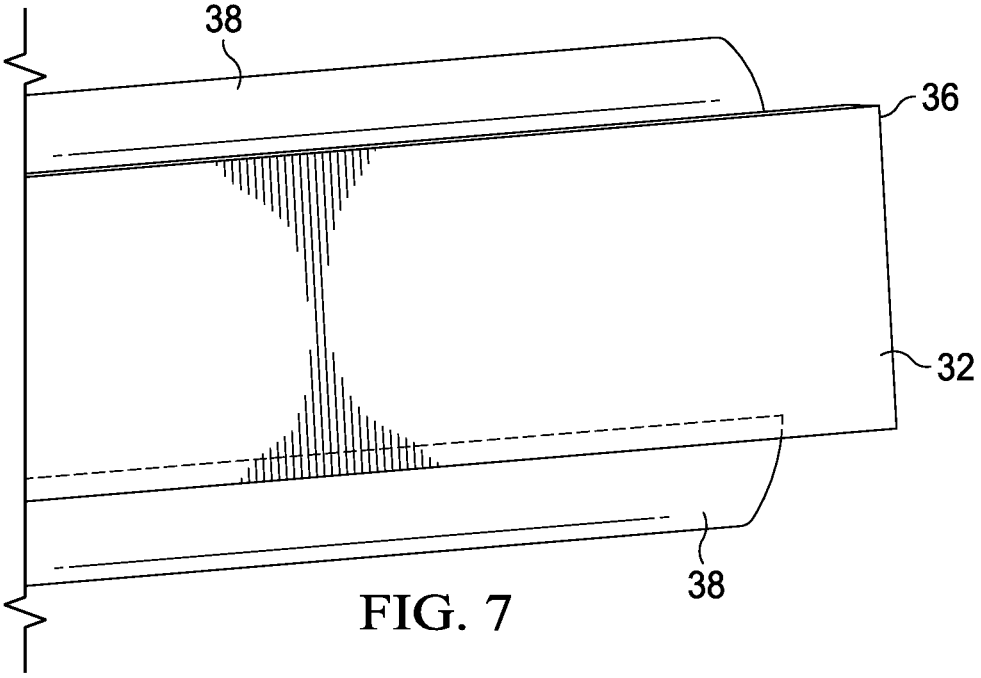
FIG. 7 is a top plan view of one of the cushion covers, showing an optional feature.
Figure 8:
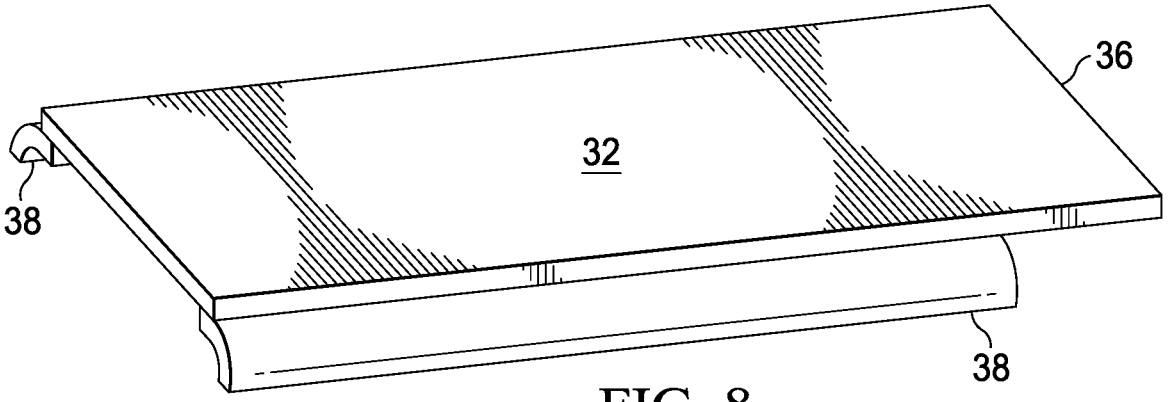
FIG. 8 is a perspective view of the FIG. 7 cover.

A further feature is depicted in FIGS. 7 and 8. In this option, cover 32 is provided with an additional flap 38 along most of the length of each side edge, so that this flap may be used to protect the sides of the cushion with which the cover is associated. As seen in each of FIGS. 7 and 8, the flaps 38 do not extend as far as the second end 36, as the second end is already extending over the front edge of the cushion. In the depicted embodiment, flap 38 is a separate piece of the web material and is affixed, such as by sewing or thermal bonding, along the bottom surface of cover 32. Preferably, and to prevent interference with the roller 50 when the cover 32 is rolled up onto the roller, the flaps 38, when present, should be folded up below the cover before the cover is rolled up.

What is claimed is:

1. An article of furniture, comprising:

a chair frame, comprising a seat base, legs that are attached to the seat base and a chair back, also attached to the seat base;

the seat base comprising an uppermost surface configured for removable placement of a seat cushion being sized and adapted for removable placement on the seat base; and an assembly for covering the chair frame, comprising:

first and second webs of water-resistant material, each web having first and second ends;

first and second biased, self-retracting spring rollers each mounted within the chair frame, positioned in the seat base below the uppermost surface of the base and adjacent rear instances of the legs;

wherein the first end of each of the first and second webs of water-resistant material is attached to the first and second spring rollers, respectively, and the second end of each of the first and second webs of water-resistant material is provided with means for removably attaching the second end to the chair frame.

2. The article of furniture of claim 1, further comprising:

a back cushion, having a solid foam core that is covered by a cloth or polymeric cover, removably attached to the chair back.

3. The article of furniture of claim 2, wherein:

in a first, deployed condition, the second web of water-resistant material extends upwardly entirely over the chair back, and the back cushion; and in a second, non-deployed condition, the web of water-resistant material is rolled onto the second biased, self-retracting spring roller.

4. The article of furniture of claim 3, further comprising:

a brush means for brushing the second web of water-resistant material as the second web is moved between the first, deployed condition and the second, non-deployed condition, the brush means being positioned to bear adjustably against the outer circumference of the second roller.

5. The article of outdoor furniture of claim 2, wherein:

at least one of the first and second webs has, along at least a portion of a first and a second side edge, a flap of additional water-resistant material configured to cover a corresponding first or second side edge of at least one of the seat back and the seat cushion, when the first web is in the deployed condition.

6. The article of furniture of claim 1, further comprising:

the seat cushion removably placed on the uppermost surface of the base;

wherein in a first, deployed condition, the first web of water-resistant material extends forwardly entirely over the seat base, and the seat cushion; and in a second, non-deployed condition, the first web of water-resistant material is rolled onto the first biased, self-retracting spring roller.

7. The article of furniture of claim 1, wherein:

in a first, deployed condition, the first web of water-resistant material extends entirely over the uppermost surface of the base; and in a second, non-deployed condition, the first web of water-resistant material is rolled onto the first biased, self-retracting spring roller.

8. The article of furniture of claim 7, further comprising:

a brush means for brushing the first web of water-resistant material as the first web is moved between the first, deployed condition and the second, non-deployed condition, the brush means being positioned to bear adjustably against the outer circumference of the roller.

* * * * *